United States Patent [19]

Pitkäjärvi

[11] Patent Number: 5,022,965

[45] Date of Patent: Jun. 11, 1991

[54] METHOD AND DEVICE IN A HEAD BOX OF A PAPER MACHINE FOR CONTROLLING DISTRIBUTION OF FIBER ORIENTATION IN A PAPER WEB

[75] Inventor: Pitkäjärvi, Jyväskylä, Finland

[73] Assignee: Valmet Paper Machinery Inc., Finland

[21] Appl. No.: 412,879

[22] Filed: Sep. 26, 1989

[30] Foreign Application Priority Data

Sep. 26, 1988 [FI] Finland ..... 884408

[51] Int. Cl.[5] ..... D21F 1/02

[52] U.S. Cl. ..... 162/192; 162/216; 162/262; 162/336; 162/338; 162/339; 162/341; 162/343

[58] Field of Search ..... 162/343, 341, 336, 340, 162/216, 339, 262, 192, 337, 338

[56] References Cited

U.S. PATENT DOCUMENTS 4,687,548 8/1987 Ilmoniemi et al. ..... 162/216

4,784,726 11/1988 Evälahti ..... 162/336

*Primary Examiner*—David A. Simmons
*Assistant Examiner*—Thi Dang
*Attorney, Agent, or Firm*—Steinberg & Raskin

[57] ABSTRACT

Method and device in a head box of a paper machine for controlling distribution of fiber orientation in a paper web in a transverse direction of the machine. In the method, the transverse speed component of a discharge jet is controlled by regulating alignment of turbulence pipes in a pipe battery of a turbulence generator in the head box. In the device of the invention, a perforated plate in the turbulence generator is provided with a heating arrangement, by which the temperature level of the perforated plate and thereby the length thereof and angle of alignment of the turbulence pipes attached to the perforated plate, in relation to the machine direction, can be controlled. The perforated plate is supported, at both opposite ends thereof, on vertical side walls of the head box, by fittings which permit thermal expansion and contraction of the perforated plate.

15 Claims, 3 Drawing Sheets

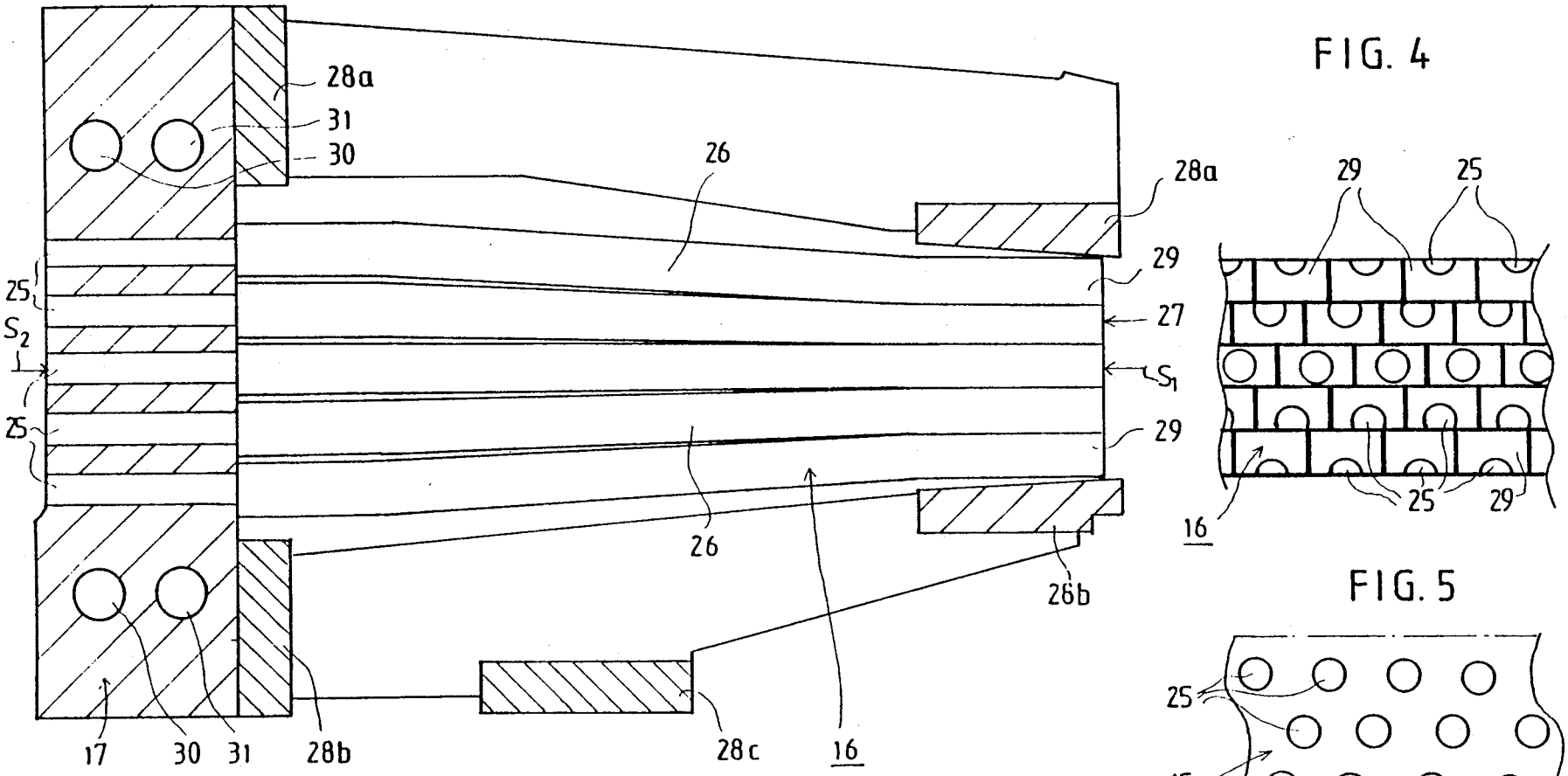
FIG. 3
FIG. 4
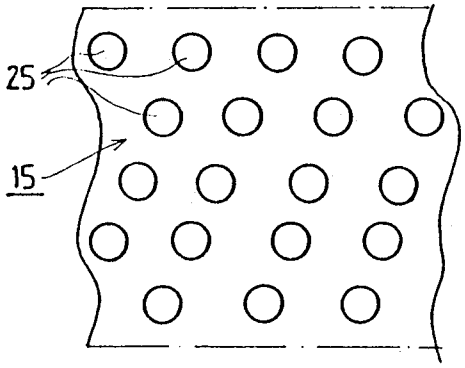
FIG. 5

METHOD AND DEVICE IN A HEAD BOX OF A PAPER MACHINE FOR CONTROLLING DISTRIBUTION OF FIBER ORIENTATION IN A PAPER WEB

BACKGROUND OF THE INVENTION

The present invention concerns a method in a head box of a paper machine for controlling distribution of fiber orientation in a paper web in a transverse direction of the machine, in which a transverse speed component of a discharge jet is regulated.

Further, the present invention concerns a device intended for carrying out this method in a head box, and which comprises a turbulence generator which is provided with a perforated plate in the transverse direction of the paper machine, to which plate inlet sides of pipes in a battery of pipes are attached, and in which outlet sides of the pipes of the battery of pipes are fixed permanently or stationarily to one another, so as to open into a discharge duct of the head box.

As known in the prior art, the discharge flow of the pulp suspension in a head box must have a uniform velocity in the transverse direction of the paper machine. By the same token, it has been known that in this flow, a detrimentally high transverse velocity may occur. Particularly in the lateral areas of the web, this transverse velocity has been detrimental, for example, by forming increased waves at the edges. The distribution of velocities noted above must be within certain limits in order that a paper can be achieved which is homogeneous across an entire width of the web with respect to grammage, formation, and strength properties, and in order that only a minimum proportion at the edges of the web will have to be cut off.

Some laser printing methods which were developed in recent years, such as sheet-heating copying and continuous-form heating copying, have imposed ever higher and novel requirements on the uniformity of the structure of fine paper to be printed by means of such methods. This is mainly due to the very rapid and intensive heating of the sheet which takes place during the printing process. An especially burdensome requirement is imposed in that the main axes of the directional distribution (orientation) of the fiber mesh in the paper, should coincide with the directions of the main axis of the paper, and that the orientation should be symmetric with respect to these axes.

The above problems have been studied. Thereat, it has been learned that the symmetry required from the fiber orientation, requires that in the discharge jet, a transverse velocity of about 2 to 3 cm/s in the transverse direction of the web, is not exceeded in any part of the web. Since the transverse velocity already arises in the discharge duct along with attenuation of an uneven main flow profile, the main attenuation must be directed at uniformity of the profile of velocity in the flow direction after the turbulence generator. Even if it were possible to dimension the distribution system in the head box fully correctly, and even if this distribution system and the turbulence generators could be manufactured so accurately that the imposed requirement is met, an apparatus manufactured in this manner would become commercially unprofitable and unfeasible because of its high cost.

In the Valmet published FI Patent Applications Nos. 75,377 and 70,616 (corresponding to U.S. Pat. No. 4,687,548), a method is described for controlling the distortion of the fiber orientation, in which flows of medium are passed to both of the opposite lateral parts of the flow duct in the head box, and by means of which the distortion of the fiber orientation is controlled, these flows of medium consisting of pulp suspension flows which are passed into the lateral passages placed facing the turbulence generator, which is situated ahead of the slice part of the head box in the direction of flow in the head box, and the magnitude and/or mutual proportion of these flows being regulated so as to control the distortion of the fiber orientation by producing a transverse flow speed in the discharge flow in the head box by means of these flows, this transverse flow speed compensating for some of the distortion of the fiber orientation. These by-pass flows of pulp suspension are regulated by means of regulation valves fitted in the by-pass flow pipes.

However, a drawback in the use of these valves, that they are susceptible to being blocked, and pulp clods may be gathered in them, which, when the clods begin moving, spoil the web or may cause blocking of flow ducts or other disturbances in operation.

The use of these regulation valves also involve the drawback that, by these means thereof, it is difficult to accomplish a range of regulation that is as wide as is necessary. It is a further drawback of the use of the regulation valves that the difference in pressure between the distributor beam and the slice cone in the head box is frequently too small for reliable control. Another drawback in the regulation method based on the use of regulation valves, involves difficulties in making the method compatible with remote control or computer control.

SUMMARY OF THE INVENTION

Accordingly, it is an object of the present invention to eliminate the drawbacks described above.

It is also an object of the present invention to provide a method and a device of simple operation and construction, the use thereof not disturbing normal operations of the head box, and by means of which the fiber orientation can be sufficiently accurately controlled.

It is a further, preferred object of the present invention to provide a method and a device which can be readily combined with remote control and computer control of a paper machine.

These and other objects ar specifically attained by the present invention which is directed to a method in a head box of a paper machine for controlling distribution of fiber orientation in a paper web in a transverse direction of the machine, in which a transverse speed component of a discharge jet is regulated, comprising the step of;

controlling said transverse speed component of said discharge jet by regulating alignment of turbulence pipes in a pipe battery of a turbulence generator in the head box.

It is also an object of the present invention to provide an apparatus for controlling distribution of fiber orientation in a paper web in a head box of a paper machine, in a transverse direction of the machine, comprising;

a turbulence generator provided with a perforated plate in said transverse direction of the paper machine, inlet sides of pipes in a battery of pipes of said turbulence generator being attached to said perforated plate, outlet sides of said pipes of said pipe battery being fixed to each other permanently or stationarily, so as to open into a discharge duct of the head box, wherein said perforated plate in said turbulence generator is provided with a heating arrangement, by means of which the temperature level of said perforated plate, and thereby length thereof and angle of alignment of said turbulence pipes attached to said perforated plate in relation to the machine direction can be controlled, and said perforated plate is supported at both opposite ends thereof on vertical side walls or equivalent support of said head box, by means of fittings that permit thermal expansion and contraction of said perforated plate.

Accordingly, with a view to achieving the objects noted above and those which will become apparent below, the method of the present invention is principally characterized by a transverse speed component of a discharge jet being controlled by regulating alignment of turbulence pipes in a pipe battery of a turbulence generator in a head box.

On the other hand, a device in accordance with the present invention is principally characterized by a perforated plate in the turbulence generator being provided with a heating arrangement, by means of which temperature level of the perforated plate and thereby length thereof, the angle of alignment of the turbulence pipes attached to the perforated plate with respect to a machine direction, can be controlled, and the perforated plate being, at both opposite ends thereof, supported on vertical side walls or equivalent of the head box by means of fittings that permit thermal expansion and contraction of the perforated plate.

In other words, the present invention is directed to a method in a head box of a paper machine for controlling distribution of fiber orientation in a paper web in a transverse direction of the machine, in which method the transverse speed component of the discharge jet is regulated. More specifically, the transverse speed component of the discharge jet is controlled by regulating alignment of turbulence pipes in a pipe battery of the turbulence generator in the head box.

The present invention is also directed to a device for carrying out this method in the head box, the device comprising a turbulence generator which is provided with a perforated plate in a transverse direction of the paper machine, to which plate inlet sides of pipes in a battery of pipes are attached. The outlet sides of the pipe in the battery of pipes are fixed to one another permanently or stationarily, so as to open into a discharge duct of the head box.

More specifically, the perforated plate in the turbulence generator is provided with a heating arrangement, by means of which the temperature level of the perforated plate and thereby the length thereof and the angle of alignment of the turbulence pipes attached to the perforated plate in relation to machine direction can be controlled. Furthermore, the perforated plate is, at both opposite ends thereof, supported on vertical side walls or the equivalent of the head box by means of fittings which permit thermal expansion and contraction of the perforated plate.

By means of the invention, a highly accurate regulation of the traverse component of the speed profile of the discharge flow, and thereby good control of the transverse distribution of the fiber orientation, is achieved.

An advantageous mode of regulating of the invention is to provide the perforated plate in the rear part of the turbulence generator with bores, through which a medium, e.g. water, is passed, the temperature and/or quantity thereof being adjusted so as to control changes in the length of the perforated plate in the transverse direction of the paper machine, and thereby controlling the alignment of the pipes in the pipe battery of the turbulence generator. The functioning is such that, when the perforated plate is heated, it becomes longer, whereby the alignment of the turbulence pipes which are attached to the perforated plate by their inlet-side ends, is changed. The change in alignment is at the maximum in the case of the pipe situated in the proximity of both of the edges of the web, while the alignment of the middle pipes remains substantially unchanged.

Instead of a heating liquid passed through the perforated plate, it is also possible to use other modes of heating in the present invention, such as electrical resistors. The electrical resistors may be fitted in blocks in the transverse direction, in which case it is also possible to employ so-called regulation in zones, i.e. it is also possible to change the alignment of the turbulence pipes locally for accurate control of the profile of distribution of fiber orientation.

The method of regulation in accordance with the invention can be readily adapted for connection with remote control or for connection with computer control of a paper machine.

BRIEF DESCRIPTION OF THE DRAWINGS

The present invention will be described in greater detail below with reference to the accompanying drawings illustrating exemplary embodiments of the present invention and to which, however, the present invention is not to be strictly confined. In the drawings

FIG. 3 is a sectional view along line III—III in FIG. 2, and a vertical cross sectional view in a machine direction of the turbulence generator in accordance with the present invention;

FIG. 4 illustrates a pipe system part of the turbulence generator as viewed in the direction $S_1$ denoted in FIG. 3; and FIG. 5 illustrates a perforated plate in the turbulence generator as viewed in direction $S_2$ denoted in FIG. 3.

DESCRIPTION OF THE PREFERRED EMBODIMENTS

Initially, a brief description will be given of the construction known per se of a head box illustrated in FIG. 1, to the extent necessary for understanding of the background of the present invention.

Figure 1:
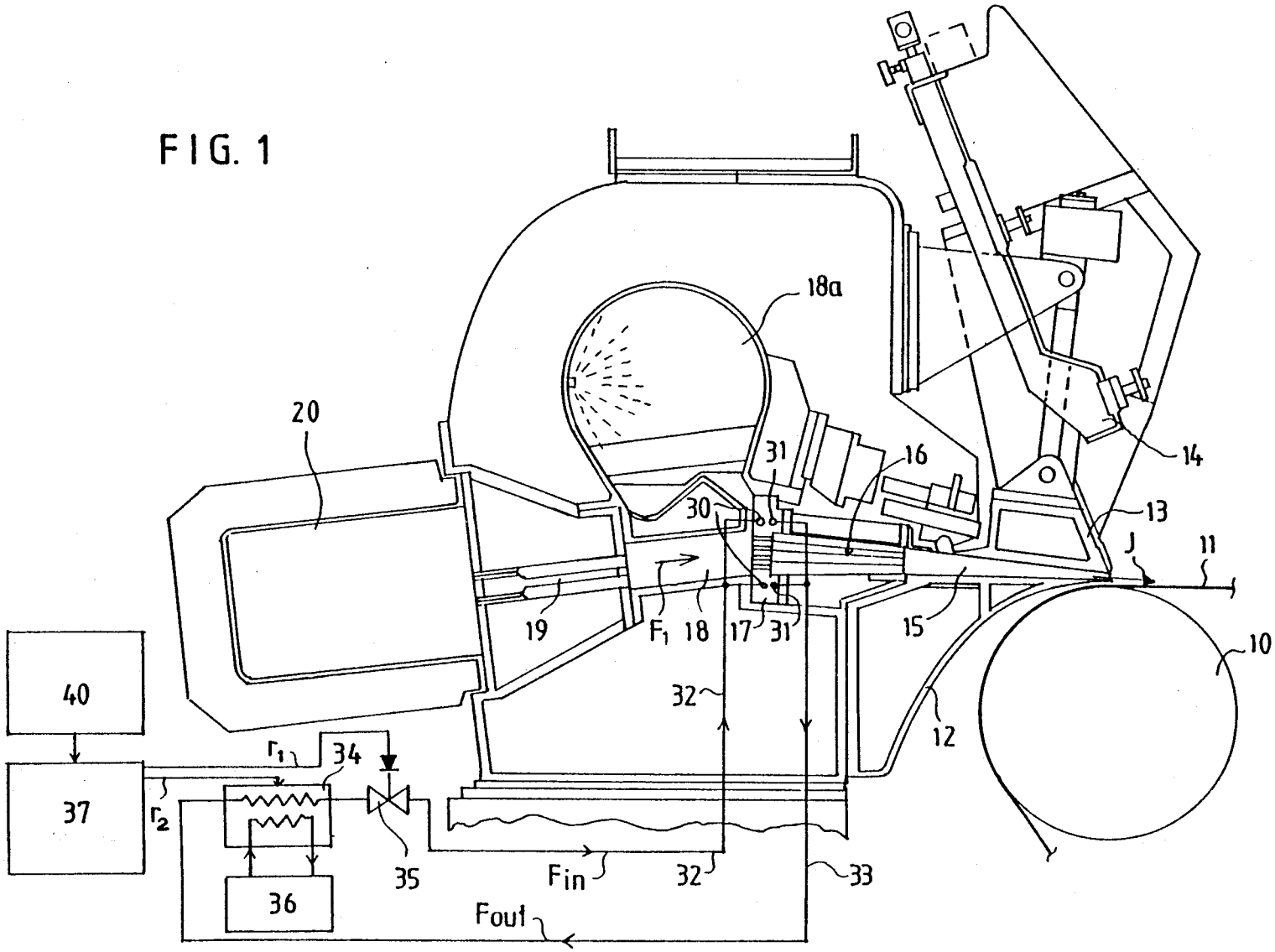
FIG. 1 is a vertical, cross-sectional view of a head box in a paper machine, in which various components and method steps of the present invention have been schematically illustrated, partially as a block diagram.

The head box illustrated in FIG. 1 feeds a pulp jet J onto a forming wire 11 that runs over a breast roll 10. A discharge duct 15 of the head box is defined by an upper wall of a lower discharge beam 12 and by a lower wall of an upper discharge beam 13. The upper discharge beam is regulated by position-regulation devices 14 known per se. In the direction of feed $F_1$ of the pulp suspension, the discharge duct 15 is preceded by the turbulence generator, which is formed by a battery of pipes 16, and with, at an outlet side 27 thereof, flow pipes 29 of rectangular section (FIG. 4) arranged to be vertically staggered in relation to one another. The flow pipes 26 begin from holes 25 in a perforated plate 17 in the turbulence generator in circular section and are smoothly converted to rectangular section 29 at the outlet side 27 of the turbulence generator. The perforated plate 17 extends across substantially the entire width of the head box in the traverse direction.

In the direction of feed of the pulp suspension, the turbulence generator first comprises the perforated plate 17, which is preceded by an equalization chamber 18, above which there is an air container 18*a* which equalizes the pressure pulsation of the pulp flow. The pulp suspension flow is fed from the distributor beam 20 through the system of distribution pipes 19 into the equalization chamber 18.

Figure 2:
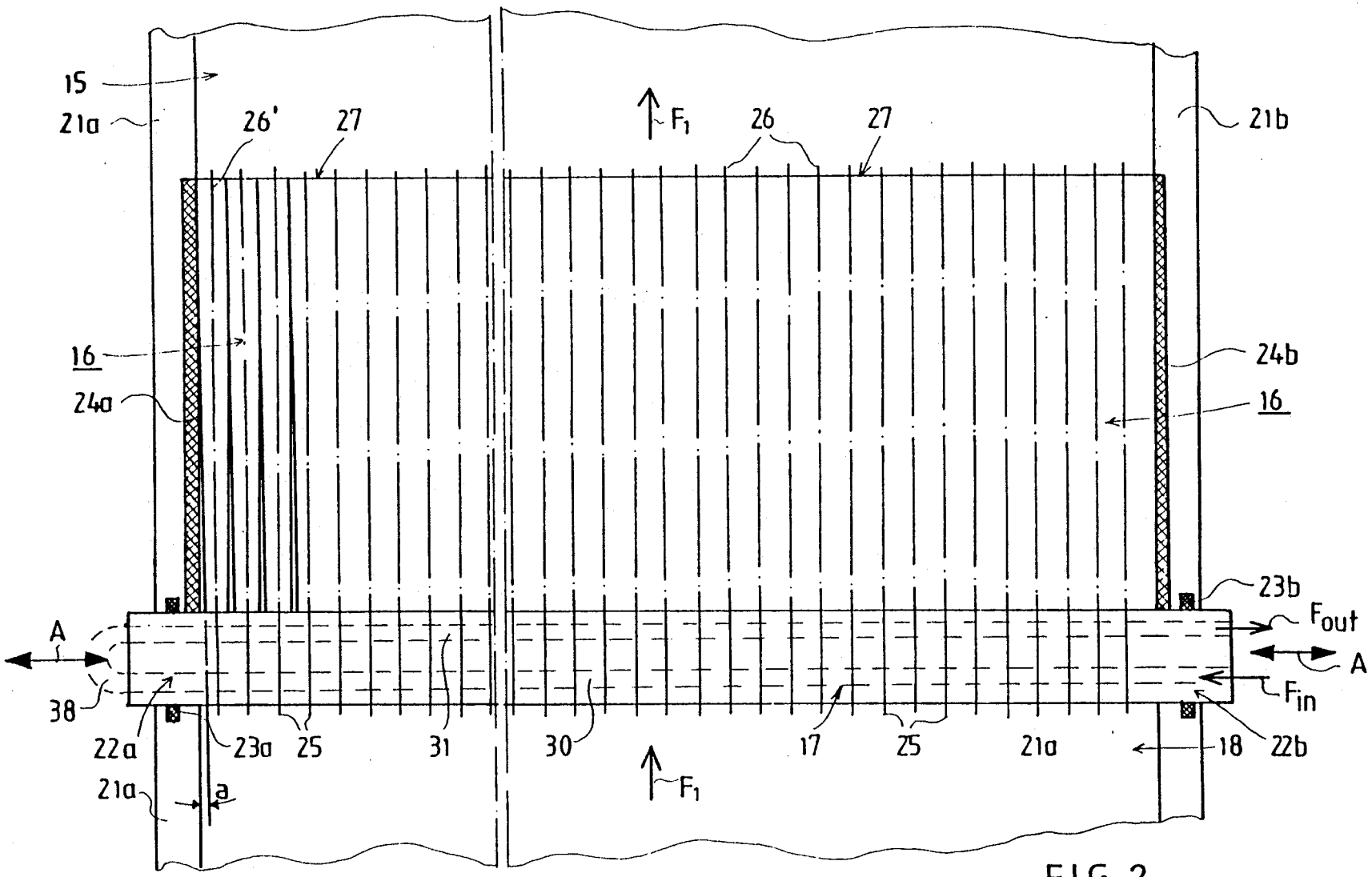
FIG. 2 is a schematic top view of the turbulence generator of the head box illustrated in FIG. 1, and provided with the regulation method and device in accordance with the present invention.

The perforated plate 17 and the pipe battery 16 are connected to the upper and lower discharge beams through transverse beams 28*a*, 28*b* and 28*c* in a manner known per se. FIG. 2 illustrates the vertical side walls 21*a* and 21*b* of the head box, between which the turbulence generator and its flow ducts are defined.

As illustrated in FIGS. 2 and 3, two parallel bores 30 and 31 have been formed into the perforated plate 17 in the turbulence generator, both above and below the flow holes 25. The bores 30 and 31 are parallel to a longitudinal direction of the perforated plate 17. As illustrated in FIG. 1, the first bore 30 communicates with the inlet pipe 32 of the temperature-controlled medium flow Fin and the second bore 31 communicates with the pipe 33 of the return flow Fout of medium. As illustrated in FIG. 2, the ends of the parallel bores 30 and 31 are interconnected by a tube part 38. The first 30 and the second 31 bores may also operate in parallel, in which case the return flows are taken from one of the ends of the bores 30 and 31.

In FIG. 1, block 34 represents a unit by means of which the medium flow Fin - Fout is both heated and circulated. The unit 34 is connected to a medium heating unit 36, e.g. an electric heating arrangement. The unit 34 and the pipe 32 regulation valve 35 are regulated by a regulation unit 37, by means of regulation signals $r_1$ and $r_2$. The regulation system 37 may operate with manual control or it may be connected to a measurement arrangement which measures the transverse profile of the fiber orientation of the web. The latter arrangement is represented by the block 40 illustrated in FIG. 1.

The perforated plate 17 is supported at both of its ends in openings 22*a*, 22*b* in the side walls 21*a* and 21*b* of the head box, by means of glide fittings, which are provided with seals 23*a*, 23*b* so that, as a result of thermal expansion/contraction, the ends of the perforated plate 17 can move in the direction of the arrows A in the glide fittings. At both sides of the pipe battery 16, situated against the inner sides of the side walls 21*a* and 21*b*, there are resilient sealing plates 24*a* and 24*b* on which the lateral pipes 26 may be supported over a part of their length or over the entire length thereof, depending upon alignment angle a. At a normal operating temperature, the alignment of the lateral pipes 26' in the pipe battery 16 is chosen, e.g., so that the direction of the lateral pipes 26' forms a certain small angle a relative to the machine direction, and that the angle of the alignment becomes smaller in a linear fashion when moving in the transverse direction from both lateral areas towards the middle area, the angle of alignment a being equal to zero degrees in the middle area.

When a medium flow Fin - Fout is fed through the bores 30 and 31 having a temperature higher than the temperature of the turbulence generator and of the pulp suspension, then the perforated plate 17 becomes longer as its ends glide in the glide fittings 22*a*, 23*a* and 22*b*, 23*b* outwardly in the direction of the arrows A. Thereby, the alignment angle a of the pipes 26 become smaller and, due to this, the transverse speed component of the discharge jet directed outwardly from the middle area of the web also becomes lower, whereby the fiber orientation is controlled in a manner known per se.

The regulation of the alignment (angle a) of the pipes 26 in the battery 16 can be illustrated by stating that the outlet ends 27 of the pipes 26 remain stationary as bound to each other, whereas the ends fixed to the perforated plate 17 change their position in the transverse direction due to the thermal movements of the perforated plate 17. By controlling the temperature of the medium flow Fin - Fout by means of the unit 34, and by possibly also controlling the flow speed of the medium flow by means of the regulation valve 35, it is possible to control the magnitude of the alignment angle a and thereby the transverse distribution of the fiber orientation.

Instead of the medium flows Fin - Fout, it is also possible to use other modes of heating known per se for heating the perforated plate 17, such as electrical resistors which may be arranged in the perforated plate 17 in blocks in the transverse direction of the machine, so that the alignment angle a of the pipes 26 and its distribution in the lateral direction, can be controlled extremely accurately.

In other words, electrical heating resistors may be fitted in or connected to the perforated plate 17 in the turbulence generator, most appropriately in blocks. The transverse thermal expansion of the perforated plate 17 is controlled by means of regulating of the electrical power supplied to these resistors or resistor blocks. Electrical conductors are provided by means of which an adjustable heating capacity can be supplied to the electrical resistor or to the resistor blocks.

Also, in conjunction with the perforated plate 17 in the turbulence generator or in conjunction with a corresponding part to which the pipes 26 and the pipe battery 16 in the turbulence generator are fixed, parts made of a magnetostrictive material may be provided, and electromagnetic coils fitted in connection therewith. The alignment a of the pipes 26 in the pipe battery 16 are controlled by means of regulating the electrical power supplied to these coils.

The present invention can also be accomplished so that both the inlet side and the outlet side of the pipe battery 16 are provided with perforated plates or the equivalent, and both of these perforated plates or the equivalent are provided with temperature regulation devices, in which case the range of regulation of the alignment angle a can be expanded if necessary. Also, by means of appropriate choice of the material of the perforated plate 17, it is possible to choose the range of regulation of the alignment angle a sufficiently wide. The perforated plate is made, e.g., of acid-proof stainless steel, because its thermal expansion coefficient is about 50% higher than that of ordinary steel.

A non-restrictive example of dimensioning of the present invention will be given below:

Thermal expansion coefficient 0.000017 $^1/°C$.

Discharge opening 9000 mm

Difference in temperature 50° C.
Elongation of beam to be heated $\Delta l$
$\Delta l = 0.000017\ ^1/^\circ C.\ 9000\ mm\ 50^\circ\ C. = 7.65\ mm$ Change in angle of alignment $a$ =

$$\text{arc tan}\left(\frac{7.65\ mm}{2}/500\ mm\right) = 0.44^\circ$$

Various details of the present invention may vary within the scope of the inventive concepts set forth above, which have been presented for the sake of example only. In other words, the preceding description of the present invention is merely exemplary, and is not intended to limit the scope thereof in any way.

What is claimed is:

1. Method in a head box of a paper machine for controlling distribution of fiber orientation in a paper web in a transverse direction of the machine, in which a transverse speed component of a discharge jet is regulated, comprising the step of controlling said transverse speed component of said discharge jet by regulating alignment of turbulence pipes in a pipe battery of a turbulence generator in the head box, and comprising the additional steps of heating or cooling a perforated plate by means of a heating arrangement fitted in connection with said perforated plate, said perforated plate being situated at the inlet side of said turbulence generator and extending across an entire width of said head box in said transverse direction, and to which said pipes of said pipe battery are attached at the inlet sides thereof, and regulating angles of alignment of said pipes in said pipe battery by means of thermal expansion or contraction produced by means of said heating or cooling of said perforated plate.

2. The method of claim 1 comprising the additional steps of passing at least one flow of heating medium through bores or ducts formed into said perforated plate, and controlling said angles of alignment of said pipes in said pipe battery by means of regulating temperature of said at least one flow.

3. The method of claim 2, comprising the additional step of controlling the angles of alignment of said pipes in said pipe battery by regulating flow speed of said at least one flow.

4. The method of claim 1, comprising the additional step of fitting electric heating resistors into said perforated plate in said turbulence generator, and controlling transverse thermal expansion of said perforated plate by regulating electric power supplied to said resistors.

5. The method of claim 4, wherein said electric heating resistors are fitted into said perforated plate in blocks.

6. The method of claim 1, comprising the additional steps of maintaining outlet-side ends of said pipes in said battery of pipes stationary in position, and adjusting positions of inlet-side ends of said pipes in said battery of pipes in the transverse direction, thereby controlling angle of alignment of said pipes relative to said machine direction.

7. The method of claim 1, comprising the additional step of supporting said perforated plate at two ends thereof by means of sealed glide fittings on side walls of said head box, whereby said plate can move in said fittings depending upon thermal expansion or contraction of said plate.

8. The method of claim 1, comprising the additional step of providing parts made of a magnetostrictive material in connection with a perforated plate in the turbulence generator of said head box, or in connection with a corresponding part to which the pipes of the pipe battery in said turbulence generator are fixed, fitting electromagnetic coils in conjunction with said parts formed of magnetorestrictive material, and controlling the alignment of the pipes in said pipe battery by regulating electric power supplied to said coils.

9. Apparatus for controlling distribution of fiber orientation in a paper web in a head box of a paper machine, in a transverse direction of the machine, comprising said head box, a turbulence generator provided with a perforated plate in said transverse direction of the paper machine, inlet sides of pipes in a battery of pipes of said turbulence generator being attached to said perforated plate, outlet sides of said pipes of said pipe battery being fixed to each other permanently or stationarily, so as to open into a discharge duct of the head box, and said apparatus further comprising:

a heating means for said perforated plate in said turbulence generator, said heating means comprising a heating unit, heat transfer means connected to said heating unit and to said perforated plate, and by means of which a temperature level of said perforated plate, and thereby a length thereof and an angle of alignment of said turbulence pipes attached to said perforated plate in relation of a machine direction can be controlled, and said perforated plate is supported at two opposite ends thereof on vertical side walls or an equivalent support of said head box, by means of fittings that permit thermal expansion and contraction of said perforated plate.

10. The apparatus of claim 9, wherein said heat transfer means comprise at least one flow pipe for transferring a heating medium, and additionally comprising at least one bore substantially parallel to a longitudinal direction of said perforated plate being formed into said plate, said at least one flow pipe for transferring a heating medium being connected to said at least one bore, and said at least one flow pipe functioning such that a heating medium can be circulated and its temperature regulated.

11. The apparatus of claim 10 additionally comprising a regulating system by means of which a temperature level of the heating medium can be regulated.

12. The apparatus of claim 11, wherein a flow speed of the heating medium can also regulated by said regulation system.

13. The apparatus of claim 10, additionally comprising electrical heating resistors connected to said perforated plate through said at least one flow pipe, and electrical conductors by means of which an adjustable heating capacity can be supplied to said electrical resistors by said heating unit.

14. The apparatus of claim 13, wherein said electrical heating resistors are connected to said perforated plate in blocks.

15. The apparatus of claim 10, additionally comprising a plurality of said bores substantially parallel to a longitudinal direction of said perforated plate being formed thereinto.

* * * * *

UNITED STATES PATENT AND TRADEMARK OFFICE

CERTIFICATE OF CORRECTION

PATENT NO. : 5,022,965
DATED : June 11, 1991
INVENTOR(S) : Kari Pitkajarvi

It is certified that error appears in the above—identified patent and that said Letters Patent is hereby corrected as shown below:

On the title page, item [75] should read as follows:

--[75] Inventor: Kari Pitkajarvi, Jyvaskyla, Finland--.

Signed and Sealed this

Seventh Day of January, 1992

*Attest:*

HARRY F. MANBECK, JR.

*Attesting Officer*

*Commissioner of Patents and Trademarks*